United States Patent [19]

Spaeth

[11] Patent Number: 4,958,554

[45] Date of Patent: Sep. 25, 1990

[54] FIRE PROTECTION FILTER

[76] Inventor: Michael M. Spaeth, Lindwurmstrasse 10/VII, D-8000 Munich, Fed. Rep. of Germany

[21] Appl. No.: 364,125

[22] Filed: Jun. 12, 1989

[30] Foreign Application Priority Data

Jun. 10, 1988 [DE] Fed. Rep. of Germany ..... 3819832

[51] Int. Cl.[5] ..... F24F 11/00

[52] U.S. Cl. ..... 98/1; 169/48

[58] Field of Search ..... 98/1; 169/45, 48

[56] References Cited

U.S. PATENT DOCUMENTS 2,106,750 2/1938 Koch ..... 98/1

FOREIGN PATENT DOCUMENTS 256239 2/1988 European Pat. Off. ..... 169/45
154671 4/1982 German Democratic Rep. ... 169/48
547019 8/1956 Italy ..... 169/45
1260007 9/1986 U.S.S.R. ..... 169/48
351101 6/1931 United Kingdom ..... 169/48
1500912 2/1978 United Kingdom ..... 169/48

*Primary Examiner*—Harold Joyce
*Attorney, Agent, or Firm*—Marks Murase & White

[57] ABSTRACT

An apparatus for containment of fire within ventilation ducts in a building. To this end, a lattice consisting of highly thermally conductive material, such as expanded metal, is placed in the cross section of the ventilation duct, the lattice then conducting the heat to the walls of the ventilation duct and is thereby able to prevent or delay the passage of the flames. Since such a lattice becomes fouled during operation of ventilation system, it must be easy to replace and clean. For this reason, it is recommended that the particle filling, in the form of bulk expanded metal balls, be placed on a rigid mid-plane consisting of transverse supports or perforated plates, etc.

23 Claims, 3 Drawing Sheets

FIRE PROTECTION FILTER

Comprehensive air intake and exhaust ducts are nowadays provided, as a rule, in major buildings, e.g., hospitals, industrial buildings, office buildings, apartment and complexes, but also in underground garages and tunnels, said ducts being used in part to supply air for breathing and in part for other purposes. Such ventilation ducts, whose main runs are actually often intended to be of solid construction and to be divided into fire control sectors, e.g., F90 or L90 sectors, pass through fire control sectors and thus always present problems for planners and construction inspectors with respect to the spread of fire from one fire control sector to another.

Therefore, mechanically closed dampers or bulkheads or other closures, consisting for example of a material that expands strongly under the effects of heat are employed as a countermeasure in such ventilation ducts at points where the walls of the ventilation duct penetrate a fire control sector.

If, however, the ventilation ducts in question are intended to provide fresh air and to exhaust spent breathing air for the inhabitants, then the closure of such ventilation ducts, e.g., intake and exhaust ducts, causes smoke to be retained in the breathing air and/or an interruption in the supply of fresh air, so that a very high danger of suffocation exists for the persons inside.

The object of the invention is therefore to devise a barrier to prevent the spread of flames in such ventilation ducts, said barrier not at all or only slightly hindering the flow of fresh air or smoky exhaust through the ventilation ducts.

This object is attained in that the cross section of the ventilation duct is completely filled for a certain distance with a flow permissive, strongly thermally conductive lattice of expanded material, preferably expanded metal consisting of aluminum foil, at each of the points where the duct penetrates the boundary between two fire control sectors.

A further embodiment of the present invention is direction to a frame insert whose dimensions are adapted to the clear cross section of the ventilation duct and which also has transverse supports, transverse to the direction of flow, in front of and behind the expanded material. Such a frame insert could be filled with either a large number of more or less parallel layers of expanded material, or with a particle filling of, for example, balls likewise consisting of expanded material, or a mixture of the two. The factor determining the choice between the two variants is, on the one hand, the specific resistance to flow and the intensity of the filtration thus produced, and, on the other, the axial length available for such a insert frame, measured along the direction of flow within the duct.

Such a insert frame can very easily be inserted into the cross section of the ventilation duct, for example through a door located in one of the walls of the ventilation duct.

Like the expanded material itself, at least the sides of such a insert frame must also have good thermal conductivity, since heat is to be conducted either directly from the expanded material to the walls of the ventilation duct or from the expanded material to the walls of the ventilation duct via the sides of the insert frame. The advantage of direct thermal conduction offers a solution in which only two lattices or other transverse supports need be anchored, e.g., by lodging, in the ventilation duct, which supports hold between them the filling, which is in direct contact with the wall.

Since the expanded material, due to its additional function as an air filter, will become fouled more or less rapidly, depending on the place at which it is deployed in such a ventilation system, which fouling can also additionally increase the flow resistance in that ventilation duct, it is necessary to clean or even to replace the expanded material in the insert at regular intervals. To do so, it is necessary that the insert frame itself be capable of being opened to facilitate simple removal of the layers of expanded material or the particle filling after the insert frame is removed from the cross section of the ventilation duct. To this end, either one point of contact with the transverse supports can be separated from the side of the insert frame, or, alternatively, one side of the frame can be separated or at least be swung away from the other side. In this manner, refilling of the insert frame in a short time is possible.

Obviously, when the insert frame is filled with a filling, the spacing between transverse supports, which are oriented transverse to the direction of flow in the ventilation duct, must clearly be less than the size of the an individual particle of filling in order to keep the filling particles from blowing away within the duct due to the flow of air. Individual, parallel bars, oriented transverse to the direction of the flow in the ventilation duct, can serve as the transverse supports, but so can a lattice of sufficiently thick dimensions made of a heat-resistant material, e.g., an expanded metal.

In case of fire, this filling within the frame, which conducts heat very strongly to the walls of the ventilation duct, also prevents a flame breakthrough and/or hinders or protects against a flame vortex or deflagration past the insert frame in the duct and into the region of the ventilation duct lying downstream of the insert frame, hence into the next fire control sector, since the rapid conduction of heat prevents the temperature behind the expansion material from reaching the ignition point, at least for a fairly long time. This thermal conduction function is only fully performed by the expanded material when the material, for example a metal like aluminum, is one that itself has a very high conductivity, and when, furthermore, this material is not thermally insulated in any way from the surrounding air. This means that this expanded material must not be intentionally covered with any material having a thermal insulation effect, nor should any such insulation be present even unintentionally, for example due to extreme fouling. Precisely for this reason, regular cleaning and/or maintenance of the insert frame and its contents is recommended from time to time.

Individual exemplary embodiments of the invention are explained in greater detail below with reference to the drawing.

Figure 1:
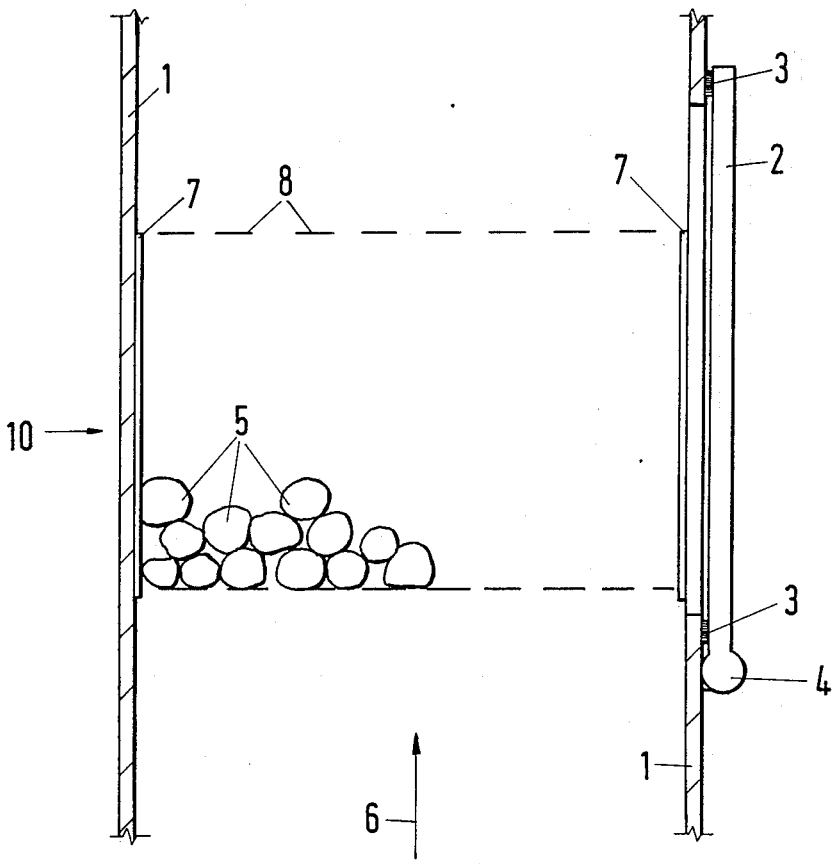
FIG. 1 shows a longitudinal section through a ventilation duct with a insert filled with particle filling.
Figure 2:
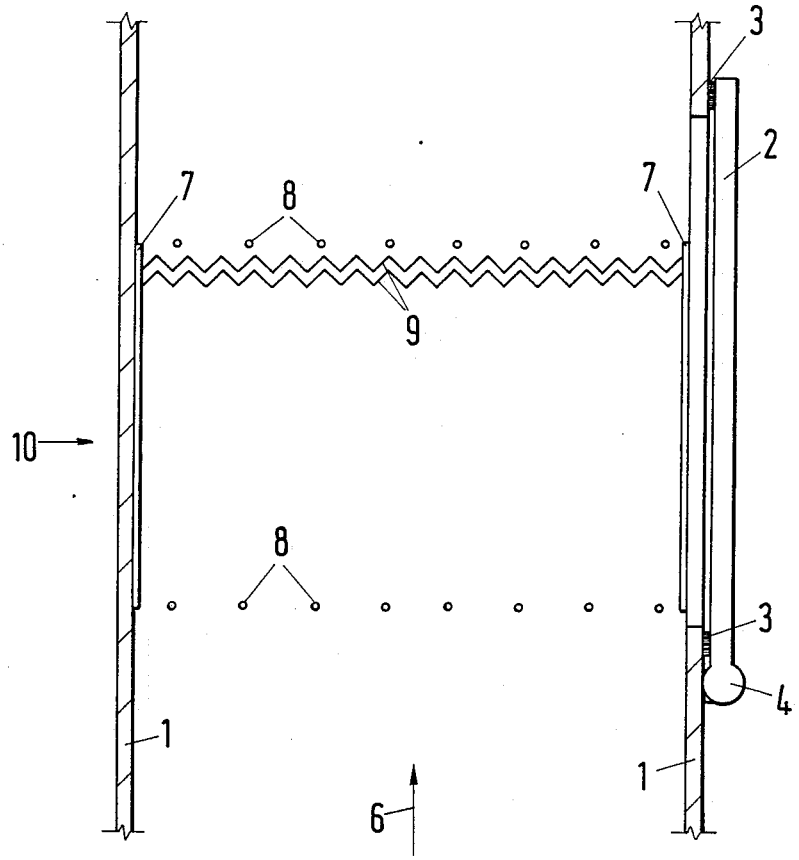
FIG. 2 shows a longitudinal section through a ventilation duct with a insert filled with layers of expanded material.

Both FIG. 1 and FIG. 2 show a longitudinal section through a ventilation duct that consists of walls 1, wherein an opening is located in one of the walls, said opening being closed from the outside by a door 2, which door is articulated to wall 1 in the vicinity of the opening in the wall by means of a hinge 4. When closed, this door 2 is held by a latch apparatus (not shown) on the adjoining wall 1, with a surrounding fireproof seal 3 between the outside edge of door 2 and wall 1.

In this manner, when door 2 is opened, it is no problem to remove the insert 10 in its entirety from the cross section of the ventilation duct. The insert 10 consists of sides 7 whose outside contour must be adapted to the inside contour of wall 1 of the ventilation duct.

Transverse supports 8, embodied in FIG. 1 as a perforated plate, are located at the front and rear faces of the insert frame 10, said supports being oriented transverse to the sides 7 and thus also transverse to the direction of flow 6 in the ventilation duct. The space enclosed within the insert frame 10, hence by the sides 7 and transverse supports 8, is completely filled with filler particles 5 made of an expanded material, only a portion of which are shown in FIG. 1 by way of example. Obviously, the perforation in the transverse supports 8 in FIG. 1 must be smaller than the diameter of the filler particles 5 in order to ensure that the filler particles are retained between the two perforated plates. In order to empty and fill the insert frame 10—after removing it from the ventilation duct—either one of the perforated plates or one of the sides 7 can be removed or at least swung away from the remainder of the insert frame.

In contrast, the insert frame 10 in FIG. 2 contains a large number of layers 9 of expanded material, for example, expanded metal, only two layers of which are likewise shown in FIG. 2 by way of example, while in practice the entire space enclosed by the insert frame is filled up with a large number of such layers, which are in contact with each other and with the sides 7. Due to the greater mechanical stability of such a filling consisting of a large number of layers 9 of expanded material, the transverse support provided by the transverse supports 8 need cover less surface, so that the transverse supports 8 can be embodied, for example, as individual, parallel rods or bars, as is the case in FIG. 2.

Aside from this, what has been said for FIG. in regard to filling and emptying the insert frame 10 applies here.

Figure 3:
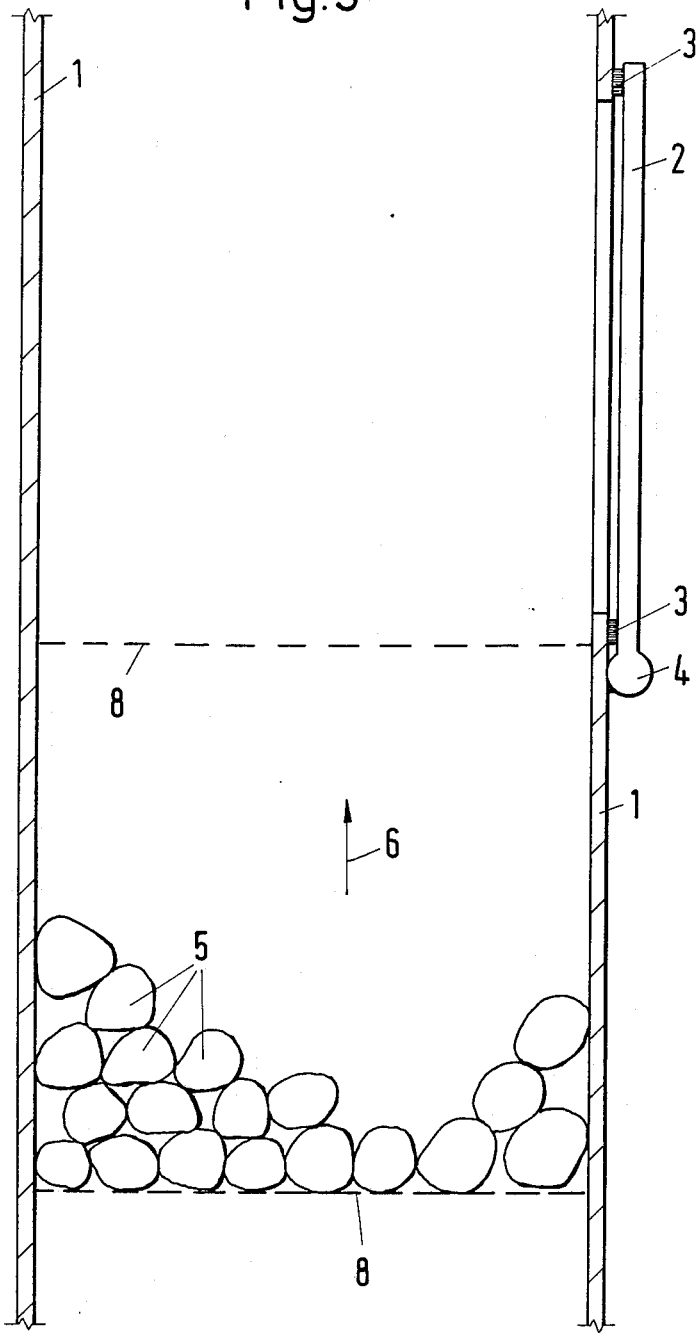
FIG. 3 shows a longitudinal section through a ventilation duct in which the filling particles are not contained in a removable insert.

FIG. 3 shows a longitudinal section through the walls 1 of a ventilation duct in which it is no longer the case that a rigid insert 10 is installed, but rather in which two transverse supports 8, oriented transverse to the direction of flow, are anchored in the cross section of the ventilation duct, between which supports the lattice is held, said lattice in this case being the filling particles 5 made of expanded metal. Perforated metal sheets and meshes with sufficiently thick dimensions, and hence also expanded metal of sufficiently thick dimensions, can serve as the transverse supports 8, said support being lodged between the walls 1 of the ventilation duct as indicated by the identical downward deflection of the transverse supports 8. Obviously, any other type of anchoring would likewise be possible.

Installation takes place in that, first, the lower transverse support 8 is anchored in the cross section of the ventilation duct through the opening accessed upon opening door 2, whereupon the desired quantity of expanded metal, in this case therefore the filling particles 5, is applied to the lower transverse support 8. To ensure coverage all the way the top, the upper transverse support is subsequently inserted into the cross section between the walls 1.

Obviously, individual layers 9 of expanded metal can be used here in place of the filling particles 5 to fill the gap between the two transverse supports 8, or a mixture of layers 9 and filling particles 5 of expanded metal can be used. For example, it would also be conceivable to use layers of expanded metal of appropriately thick dimensions as the transverse supports 8; these transverse supports 8 would then actually take on the double function of static support and thermal conduction, so that in this case not only one but a multiplicity of layers of sufficiently thickly dimensioned expanded metal could be installed as the top or bottom transverse support 8, respectively, between which additional filling particles 5 could potentially be located.

We claim:

1. A fire protection filter for a ventilation duct comprising a lattice of at least one layer made of an air permeable, highly thermally conductive, expanded aluminum foil less than 0.01 mm thick, said lattice being adapted to be mounted transverse to the direction of flow in the ventilation duct and having a length along the direction of flow sufficient to prevent flames from going through said lattice without significantly impeding the flow.

2. The fire protection filter of claim 1 wherein said lattice has an input end, an output end and at least one side and further comprises a transverse support located on each end to hold the lattice in place.

3. The fire protection filter of claim 2 wherein said transverse support comprises a plurality of individual rodlike bars.

4. The fire protection filter of claim 2 wherein said transverse support comprises a perforated metal sheet.

5. The fire protection filter of claim 2 wherein said transverse support comprises a metal mesh.

6. The fire protection filter of claim 2 wherein said transverse support comprises rigid expanded metal layer.

7. The fire protection filter of claim 2 further comprising a side wall joined to said transverse supports to form an insert enclosing said lattice, said side walls having an outside contour adapted to conform to the inside contour of the walls of the ventilation duct.

8. A fire protection filter for a ventilation duct comprising a lattice of a plurality of filter particles made of an air permeable, highly thermally conductive, expanded aluminum foil less than 0.01 mm thick, said lattice having a length along the direction of flow sufficient to prevent flames from going through said lattice without significantly impeding the flow.

9. The fire protection filter of claim 8 wherein said filler particles are ball shaped.

10. The fire protection filter of claim 8 wherein said lattice has an input end, an output end and at least one side and further comprises a transverse support located on each end to hold the lattice in place.

11. The fire protection filter of claim 10 wherein said transverse support comprises a plurality of individual rodlike bars.

12. The fire protection filter of claim 10 wherein said transverse support comprises a perforated metal sheet.

13. The fire protection filter of claim 10 wherein said transverse support comprises a metal mesh.

14. The fire protection filter of claim 10 wherein said transverse support comprises rigid expanded metal layer.

15. The fire protection filter of claim 10 further comprising a side wall joined to said transverse supports to form an insert enclosing said lattice, said side walls having an outside contour adapted to conform to the inside contour of the walls of the ventilation duct.

16. A fire protection filter for a ventilation duct comprising a lattice of at least one layer and a plurality of inserts of an air permeable, highly thermally conductive, expanded aluminum foil less than 0.01 mm thick, said lattice being transverse to the direction of flow in the ventilation duct and having sufficient thickness to prevent flames from going through said lattice without significantly impeding air flow.

17. The fire protection filter of claim 16 wherein said inserts are ball shaped.

18. The fire protection filter of claim 17 wherein said lattice has an input end, an output end and at least one side and further comprises a transverse support located on each end to hold the lattice in place.

19. The fire protection filter of claim 18 wherein said transverse support comprises a plurality of individual rodlike bars.

20. The fire protection filter of claim 18 wherein said transverse support comprises a perforated metal sheet.

21. The fire protection filter of claim 18 wherein said transverse support comprises a metal mesh.

22. The fire protection filter of claim 18 wherein said transverse support comprises rigid expanded metal layer.

23. The fire protection filter of claim 18 further comprising a side wall joined to said transverse supports to form an insert enclosing said lattice, said side walls having an outside contour adapted to conform to the inside contour of the walls of the ventilation duct.

* * * * *